United States Patent [19]

Allen et al.

[11] 4,166,539

[45] Sep. 4, 1979

[54] ENVELOPE ASSEMBLY

[75] Inventors: Robert H. Allen, North Tonawanda; Victor J. Robertson, Niagara Falls, both of N.Y.

[73] Assignee: Moore Business Forms, Inc., Niagara Falls, N.Y.

[21] Appl. No.: 809,922

[22] Filed: Jun. 24, 1977

[51] Int. Cl.[2] ..... B65D 27/34

[52] U.S. Cl. ..... 206/629; 206/632; 229/69

[58] Field of Search ..... 229/69; 206/610, 611, 206/620, 605, 609, 629, 632

[56] References Cited

U.S. PATENT DOCUMENTS

| | | | |
|---|---|---|---|
| 780,883 | 1/1905 | Hinchman | 206/620 |
| 890,538 | 6/1908 | Stillwell | 206/610 |
| 910,862 | 1/1909 | Ritchie | 206/610 |
| 1,324,100 | 12/1919 | Binkowitz . | |
| 2,056,472 | 10/1936 | Lewis | 206/610 |
| 2,828,065 | 3/1958 | Heywood . | |
| 3,051,371 | 8/1962 | Day . | |
| 3,111,255 | 11/1963 | Skowronski | 206/611 |
| 3,297,235 | 1/1967 | Robbins . | |
| 3,451,539 | 6/1969 | Wysocki | 206/620 X |
| 3,464,621 | 9/1969 | Day . | |
| 3,620,441 | 11/1971 | Robbins | 206/620 |
| 3,650,463 | 3/1972 | Christiansen | 206/610 X |
| 3,777,971 | 12/1973 | Steidinger | 229/69 X |
| 4,010,889 | 3/1977 | Allen et al. | 229/69 |

FOREIGN PATENT DOCUMENTS

| | | | |
|---|---|---|---|
| 159599 | 8/1903 | Fed. Rep. of Germany | 206/610 |
| 469192 | 7/1914 | France | 206/610 |
| 19288 | 12/1914 | France | 206/610 |
| 536595 | 12/1955 | Italy | 206/610 |

*Primary Examiner*—Stephen P. Garbe

*Attorney, Agent, or Firm*—Watson, Cole, Grindle & Watson

[57] ABSTRACT

A stuffed, sealed envelope assembly has superimposed front and back plies with insert material within the envelope unattached to the plies so as to be freely disposed therein. At least one cut line or a line of perforations is provided in one of the envelope plies in the vicinity of an edge of the insert to facilitate opening of the envelope for exposing the insert for extraction. An outline of a simulated flap is applied to the outer surface of the one envelope ply so as to overlie or be delimited by the cut line or line of perforations. Other seam lines may be applied to the same outer surface so as to give the impression, together with the flap outline, of a folded-flap envelope construction. The envelope assembly is therefore capable of being opened for exposing the insert in a manner similar to that of a folded-flap construction.

Alternatively, superimposed lines of perforations defining a removable tear strip are provided in the plies along a marginal edge of the plies between such marginal edge and an edge of the insert material lying adjacent thereto. The envelope assembly is accordingly opened for exposing the insert upon removal of the tear strip as in a folded-flap envelope construction.

8 Claims, 17 Drawing Figures

10c
31
36
47
49
29
35
48

53'
52
51
53
54
55
56
10d 57
58
59
10e 63
61
62
10f 65
64
67
66
10g 69
72
71
68
10h 73
75
74
10i 76
78
77
34
10j

ENVELOPE ASSEMBLY

BACKGROUND OF THE INVENTION

This invention relates generally to a stuffed, sealed envelope assembly of outer plies having an insert freely contained therein, and more particularly to such an assembly which simulates a standard folded-flap construction and is capable of being opened for exposing the insert for extraction in a manner similar to that of a standard folded-flap envelope construction.

Stuffed, sealed envelope assemblies having inserts contained therein are typically opened upon the removal of a tear strip located at one end of the envelope and overlying an end of the insert, the tear strip being defined by superimposed lines of weakening. In several known constructions of this type, the insert is removably attached to the outer envelope plies in some manner and is extracted as the tear strip side of the envelope and a side opposite the tear strip side are grasped and snapped apart whereupon the tear strip is removed and the insert is extracted. Such an envelope construction is shown, for example, in U.S. Pat. No. 3,554,438.

Other stuffed, sealed envelope constructions have inserts freely disposed therein, i.e., the insert material is unattached to any portion of the outer envelope plies. Such a construction is disclosed in U.S. Pat. No. 4,010,889 wherein the "free" insert is immobilized by means of chip elements secured to the outer plies in abutting engagement with marginal edges of the insert material but unattached thereto. Other stuffed, sealed envelope constructions having "free" inserts are shown in U.S. Pat. No. 3,339,827 and in U.S. Pat. No. 3,777,971, the insert in the former being immobilized through peripheral lines of securement of the outer plies and in the latter by means of embossments provided in an outer envelope ply.

Each of the envelopes of the aforementioned "free" insert constructions has a tear strip at one end overlying an end of the insert and being defined by superimposed lines of weakening so that, upon removal of the tear strip, an end of the insert is exposed for extraction, or the tear strip side and a side opposite thereto may be grasped and snapped apart to facilitate insert extraction.

When extracting the insert in the manner aforedescribed, the connecting ties at the lines of perforations connecting the tear strip to the remainder of the envelope must separate upon tear strip removal for the extraction operation to function properly. However, if these connecting ties are made insufficiently keen during production, a clean separation of the tear strip is not affected. The insert must then be extracted in a manner not intended for such a stuffed, sealed evelope construction which is not only frustrating but may actually result in some destruction of a portion of the insert.

Also, it has been found that the recipients of these stuffed, sealed envelopes may be unaccustomed to following the necessary instructions to "grasp and snap" or to otherwise remove the tear strip for opening the envelope and extracting the insert. They may have only experienced receiving the normal top or side opening correspondence envelopes in the mails which are of the standard folded-flap envelope variety wherein the folded sealed flap of such construction is of course normally peeled apart by the recipient, or a letter opener or finger is inserted through an unsealed portion thereof for tearing along a fold line of the flap.

SUMMARY OF THE INVENTION

It is therefore an object of the present invention to provide a stuffed, sealed envelope construction which offers the advantages of ease and economy in assembly and permits high speed addressing by computer output printers as a continuous connected series of envelopes while at the same time offers the advantages of ease and simplicity and perhaps less confusion for some, as provided by a folded-flap envelope construction in opening such an envelope for extracting its insert.

A stuffed, sealed envelope assembly having a free insert unattached to any portion of the envelope but held in the desired registration position therein, has been modified in accordance with the present invention for carrying out the aforementioned objective. The stuffed, sealed envelope having a "free" insert therein, as for example disclosed in U.S. Pat. No. 4,010,889, particularly lends itself to the present unique manner developed for opening the envelope and exposing the insert for extraction since the insert is unattached to the outer envelope plies and is therefore easily extracted upon opening of the envelope without the need to break any connecting ties between the insert and some part of the envelope.

In carrying out the invention, a stuffed, sealed envelope is constructed as having superimposed outer plies with the insert contained therein in a manner unattached to the plies, means being provided in only one of the plies for opening the envelope and exposing the insert for extraction similarly as in the manner of a standard folded-flap correspondence envelope. At least one cut line is provided in this one envelope ply so as to define a pocket access opening. A plurality of perforations defining access openings may also be provided in this ply. A simulated envelope flap defining a portion of this outer ply overlies an edge of the insert. The cut line and/or the perforations delimit at least a portion of the simulated flap, or are otherwise located at least in part within the confines of the simulated flap. Therefore, upon insertion of an opener through one of the access openings, at least a portion of the simulated flap is separated from the remainder of the envelope upon exertion by the opener of a force causing the separation.

When insert retaining chip elements are utilized to immobilize the insert, as disclosed in U.S. Pat. No. 4,010,889, portions of such chip elements underlying a separable portion of the outer ply may be secured thereto so as to be moved away from the insert upon opening of the envelope so as to avoid any possible interference with the extraction operation.

Various types of perforation lines alone or together with a cut line or cut lines may be provided to facilitate envelope opening, with one or more of such lines outlining a simulated flap, or such a simulated flap overlying one or more of such lines.

An alternative or optional means for opening a stuffed, sealed envelope assembly having a free insert therein is also provided for exposing the insert. Superimposed lines of perforations in the plies lie between an edge of the insert and an adjacent marginal edge of the plies and define a tear strip which, when removed, opens the envelope and exposes the insert for extraction similarly as in a folded-flap construction. The tear strip may be provided in lieu of or in addition to the cut line and/or the plurality of perforations.

DETAILED DESCRIPTION OF THE INVENTION

Figure 1:
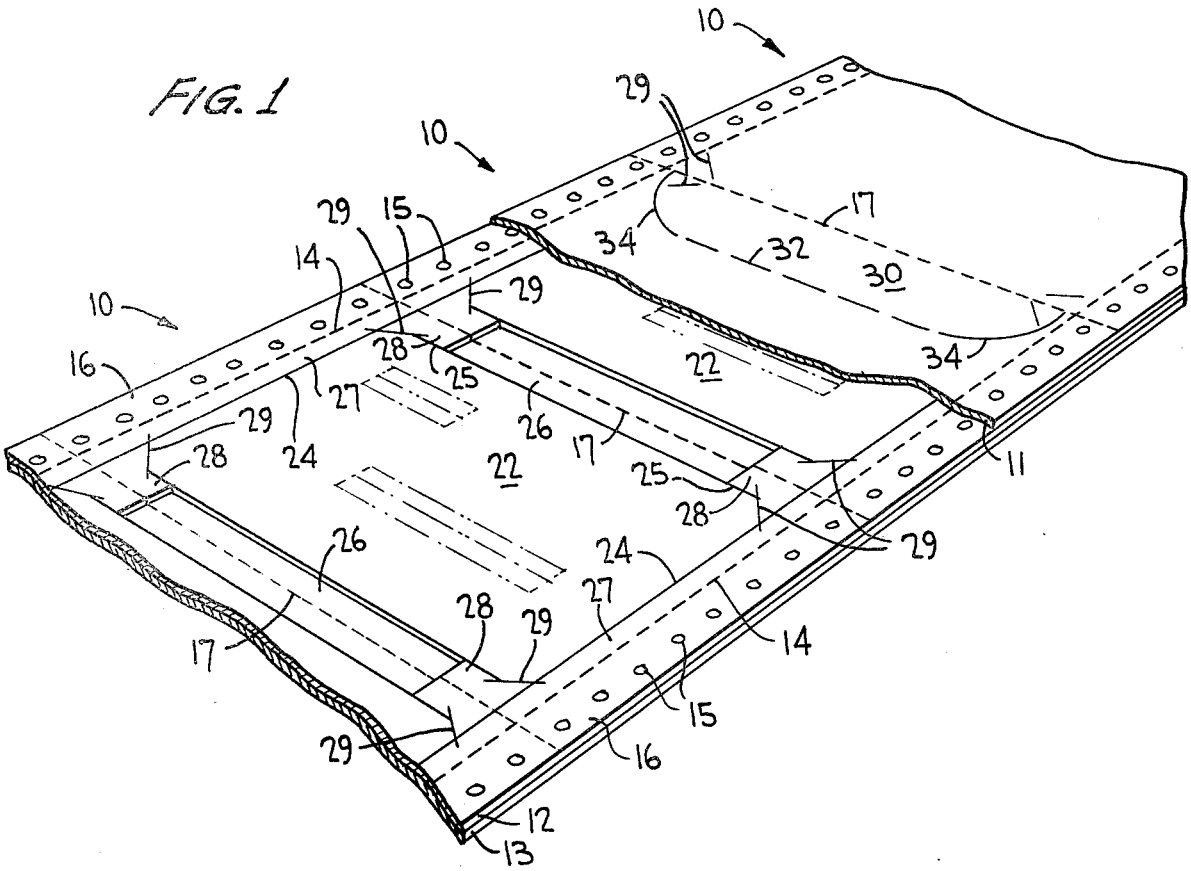
FIG. 1 is a perspective view of a series of connected envelopes constructed in accordance with the present invention with a portion thereof broken away for clarity.

Turning now to the drawings wherein like reference characters refer to like and corresponding parts throughout the several views, a continuous series of connected envelopes each generally designated 10 is shown in FIG. 1 constructed similarly in accordance with the commonly owned U.S. Pat. No. 4,010,889 with the exception of the tear strip disclosed therein. The entire disclosure of U.S. Pat. No. 4,010,889 is therefore specifically incorporated herein by reference as it relates to the assembly of a stuffed, sealed envelope having an insert immobilized therein by means of chip elements attached to the outer envelope plies which abut against edges of the insert but are unattached thereto.

Figure 3:
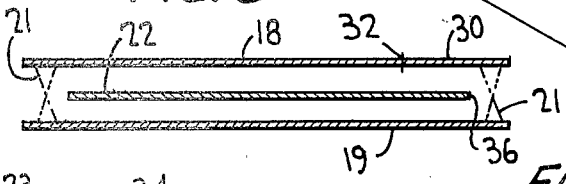
FIGS. 3 and 4 are sectional views taken respectively along the lines 3—3 and 4—4 of FIG. 2.
Figure 4:
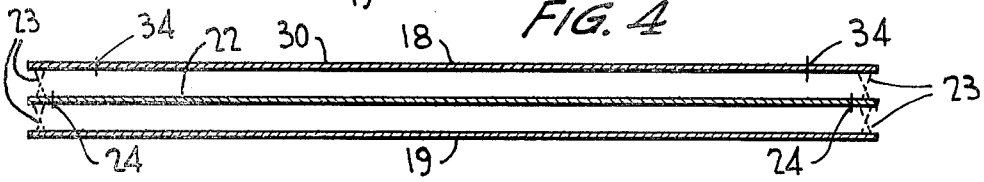

Individual envelope assemblies 10 are constructed of continuous superimposed sheets 11, 12 and 13 having superimposed longitudinal lines 14 of weakening therein near opposite side edges as well as spaced feed holes 15 defining removable feed bands 16. Superimposed transverse lines 17 of weakening separate the sheets into individual envelope assemblies 10 having lower and upper envelope plies 18 and 19, in the form of back and front panels, respectively, adhesively secured together along portions of their top and bottom by lines 21 of adhesive (FIG. 3) and secured together along the remainder of their periphery via an insert ply 22 as along lines 23 of adhesive (FIG. 4). It should be pointed out that the back panels are designated 18 and are illustrated as uppermost in the drawings for the sake of clarity. It will be seen that the back of the present stuffed, sealed envelope assembly includes the envelope opening means since the back surface of the envelope simulates a folded-flap envelope construction as intended.

A single insert ply 22 is shown disposed within outer envelope plies 18 and 19, although it should be recognized that a plurality of such plies may be so disposed together with one or more return envelopes without departing from the scope of the invention. And, carbon transfer material may be disposed between all or selected portions of the insert parts and plies, or carbonless transfer material may be coated on all or part of the mating surfaces of the insert parts and plies for transferring indicia from upper ply 19 through the assembly.

Plies 22 are constructed from continuous sheet 12 by cutting along longitudinal lines 24 lying just inside lines 14, as well as by cutting along short transverse lines 25 while diecutting to form cutouts 26 similarly as in the aforementioned U.S. Pat. No. 4,010,889. Retention chips or elements 27 and 28 are thereby defined in abutting engagement with the shorter side edges and with portions of the longer end edges of the insert ply as shown. Chips 28 remain attached to their respective insert plies and to each other across lines 17 of weakening and, sometime during the assembly process, are severed from their respective insert plies along short diagonal cuts 29 which intersect cut lines 24 and 25. The insert plies are therefore rendered completely free from attachment to any portion of the outer plies.

Figure 2:
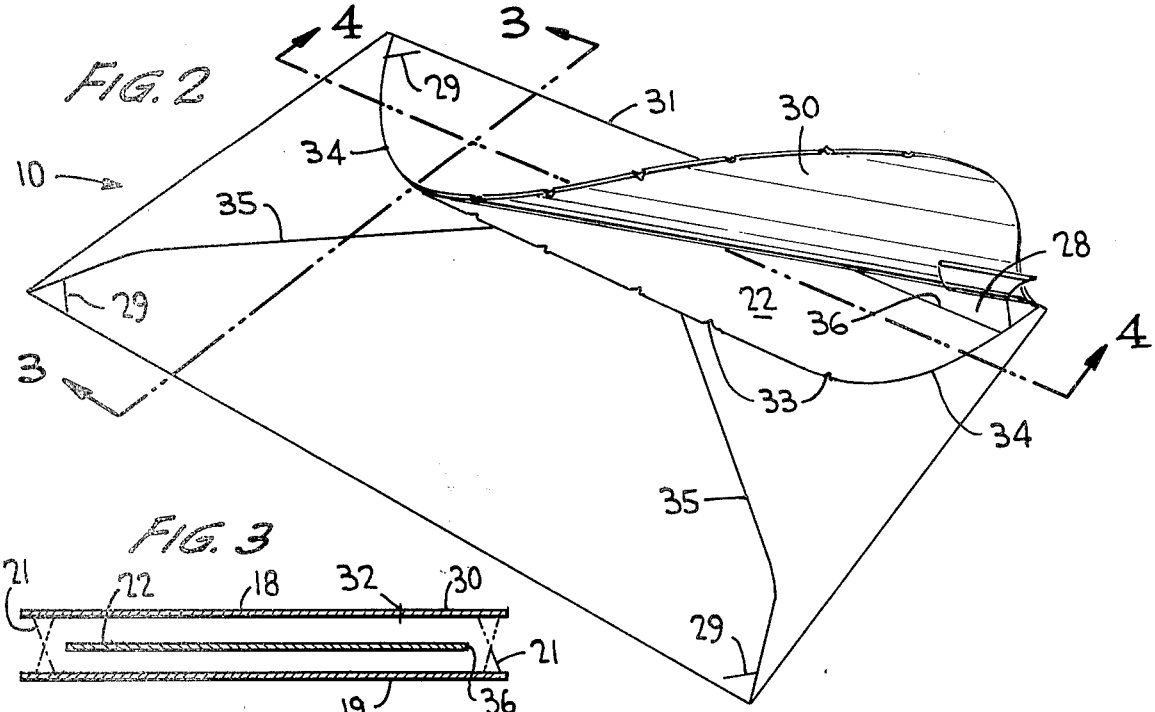
FIG. 2 is a slightly enlarged perspective view of a single envelope assembly separated from the series shown in FIG. 1 and with the feed bands removed, showing the process of opening the envelope in accordance with the invention.

In accordance with the invention, one of the sheets such as 11, from which lower plies 18 are formed, is provided with envelope opening means directly therein for each assembly 10. As clearly shown in FIGS. 2 to 4, the means in accordance with one embodiment for opening the envelope and exposing insert 22 for extraction comprises a portion 30 of ply 18 extending along a marginal edge 31 of the envelope. Portion 30 is delimited by a line 32 of perforations presenting keen connecting ties 33 (shown broken in FIG. 2), and is further delimited by continuous cut lines 34 extending from opposite ends of line 32 toward marginal edge 31 as shown in FIGS. 1 and 2. Alternatively, portion 30 may be defined by a continuous line of perforations having curved ends. In this first embodiment, portion 30 is otherwise secured in place to envelope ply 19 along line 21 of adhesive (FIG. 3). Cut lines 34 are illustrated as slightly curved although they may be straight if desired. And, only one of such cut lines may be provided, the other cut line 34 being replaced by an extension of line 32 of weakening.

It can be seen that lines 32 and 34 outline a simulated flap extending along marginal edge 31. Lines 35 are applied by inking or in any other normal manner to the outer surface of ply 18 and extend outwardly from line 32 or 32*a* so as to simulate, together with the outline of the simulated flap, a folded-flap envelope construction of a typical top opening correspondence envelope.

Cuts 34 define access openings as well as lift tabs lying in the same plane as ply 18. Accordingly, the stuffed, sealed envelope assembly may be opened upon insertion of the addressee's thumb or forefinger through any one of these cuts so that, as portion 30 is partly lifted it may be separated along line 32 so as to break connecting ties 33 as portion 30 is peeled along this line. It may then be bent upwardly along glue line 21 as shown in FIG. 2 thereby exposing an edge 36 of the insert. A portion of the insert adjacent this edge may then be grasped for extraction of the insert similarly as in the manner of a known folded-flap correspondence assembly. Alternatively, a letter opener may be inserted through one of the access openings defined by such cuts to facilitate breaking of the connecting ties as the opener is moved along line 32 or to facilitate separation of portion 30 from ply 19 as the opener is moved along top line 21 of adhesive at marginal edge 31. Furthermore, portion 30 may be entirely removed upon simply peeling it away after part of it is grasped through one of the access openings and separated along line 32 as well as along top line 21 of adhesive at marginal edge 31, or the addressee may choose to simply tear portion 30 along edge 31 or elsewhere upon grasping portion 30 through one of cuts 34.

Figure 5:
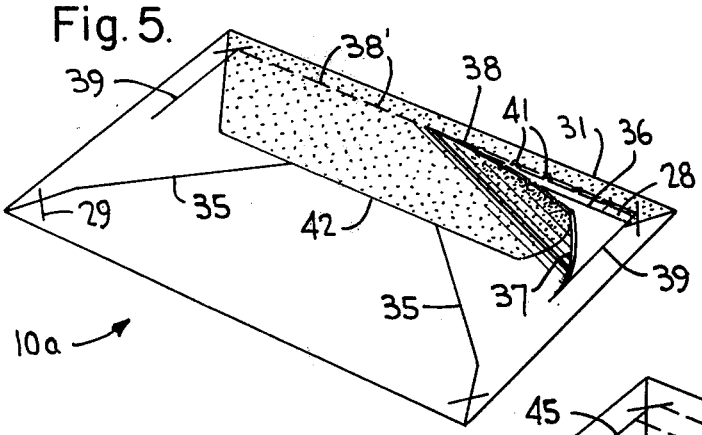
FIGS. 5 to 14 are perspective views of other embodiments according to the invention shown at a slightly reduced scale, the envelope assemblies of FIGS. 7, 9, 10, 11 and 12 being shown partly broken away for viewing a portion of the insert.

In another embodiment according to the invention, a stuffed, sealed envelope assembly 10*a* shown in FIG. 5 has means for opening the envelope and exposing the insert for extraction which comprises a portion 37 of ply 18 delimited by a line 38 of perforations lying closely adjacent marginal edge 31, and further delimited by continuous cuts 39 located at opposite ends of line 38 and extending inwardly of the envelope as shown. Line 38 of perforations likewise contains a series of keen connecting ties 41 except that such line is disposed outwardly of edge 36 of the insert as compared to inwardly thereto as shown in FIGS. 2 and 5. And, cuts 39 extend away from marginal edge 31 rather than toward it as in FIG. 2. Furthermore, in the FIG. 5 embodiment, an outline 42 of a simulated flap extending from marginal edge 31 is printed or otherwise applied to the outer surface of ply 18, and lines 35 are likewise applied to the exterior surface of ply 18 extending from outline 42 so that, together therewith, the back of a folded-flap envelope construction is simulated. Portion 37 of ply 18 in FIG. 5 may lie at least partially within outline 42 and such outline may comprise stippling as shown or lines forming the simulated flap. Also, a line of perforations may be substituted for one or more cuts 39.

Envelope 10*a* of FIG. 5 may be opened upon insertion of the thumb or forefinger or letter opener through either of cut lines 39, or through a cut 38' of the line of perforations, or through a cut of a line of perforations substituted for cuts 39, to facilitate the breaking of connecting ties 41 as portion 37 is separated along line 38. Of course, portion 37 may be completely removed from the envelope during the opening procedure by simply separating along line 38 and tearing it elsewhere between cuts 39. And, it should be pointed out that line 38 could lie closer to marginal edge 31 than shown in FIG. 5, and chip elements 28 underlying portion 37 could be attached thereto so as to be moved out of abutting engagement with insert 22 as portion 37 is separated. Alternatively, line 38 could be eliminated and lines 39 extended to edge 31. Plies 18 and 19 would then be secured together at edge 31 along line 22 of fugitive (releasable) glue thereby facilitating easy separation of the plies along edge 31.

Figure 6:
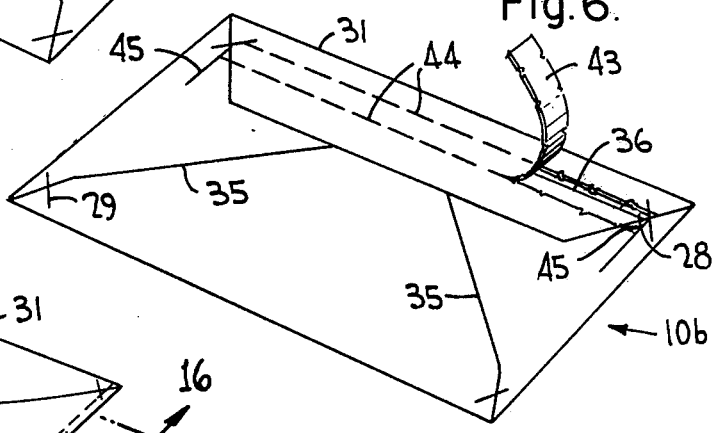

In accordance with another embodiment of the invention, a stuffed, sealed envelope assembly 10*b* is illustrated in FIG. 6 and is constructed in the same manner as all other embodiments except that the means for opening the envelope and exposing the insert comprises a tear strip 43 delimited by a pair of spaced lines 44 of perforations with cut lines 45 connecting lines 44 and located at opposite ends thereof. This tear strip overlies top edge 36 of the insert so that, as it is peeled away as shown in FIG. 6, edge 36 is exposed for removal of the insert. And, similarly as in the FIG. 5 embodiment, tear strip 43 could lie closer than shown to marginal edge 31 of the envelope so that chips 28 would more fully underlie this tear strip. And, short lines of perforations may be provided in lieu of cuts 45. Alternatively, tear line 44 lying adjacent edge 31 could be eliminated and lines 45 extended to edge 31. Plies 18 and 19 would then be fugitively (releasably) secured together along edge 31.

Figures 7, 8, 9, 10, 11, 12, 13, 14:
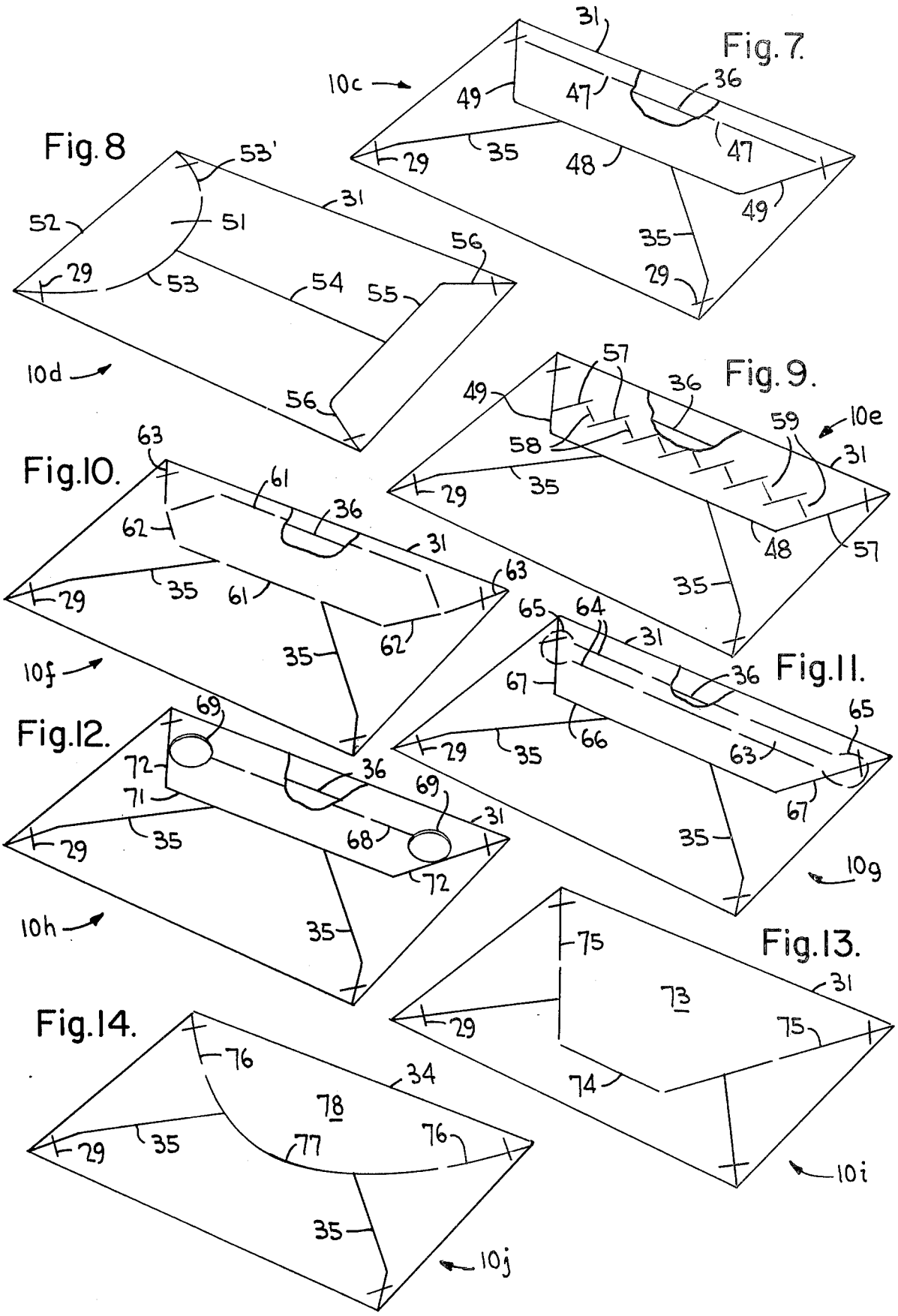

Stuffed, sealed envelope assemblies 10*c* through 10*j* are respectively shown in FIGS. 7 through 14, and are each constructed in the same manner as the aforedescribed embodiments except that the means for opening the envelope and exposing the insert varies slightly for each construction. Envelope assembly 10*c* of FIG. 7 is provided with a line 46 of perforations adjacent marginal edge 31 of the envelope. The line is defined by a series of cuts 46' with connecting ties 47 lying therebetween, and line 46 is made to lie slightly outwardly of edge 36 of the insert. An outline of a simulated flap defined by application of lines 48 and 49 to the outer surface of ply 18 extends along marginal edge 31 and surrounds line 46 of perforations. Lines 49 may be straight as shown or curved, if desired, and lines 35 may also be applied to the outer surface of the envelope in any normal manner so as to simulate together with lines 48 and 49 a folded-flap envelope construction. In opening envelope assembly 10*c*, an opener such as the addressee's thumb or forefinger, or a letter opener, is inserted through one of the cuts 46' for breaking connecting ties 47 or for otherwise tearing the envelope along marginal edge 31. The insert is therefore exposed and may be easily extracted through the opening presented upon separation of the envelope in such fashion. It can be seen that assembly 10*c* is similar to envelope assembly 10*a* except that cuts 39 are eliminated in FIG. 7.

Envelope assembly 10*d* of FIG. 8 is substantially the same as the envelope 10 construction except that a separable side portion 51 is provided in lieu of a separable top portion. This side portion 51 lies along a side marginal edge 52 of the envelope assembly and is delimited by a line 53 of perforations which is partially curved so as to outline a simulated envelope flap. Lines 54, 55 and 56 are applied to the same outer surface of assembly 10*d* so as to simulate together with line 53 a folded-flap side opening envelope construction. Envelope 10*d* is opened in the exact same manner as envelope 10 described with reference to FIG. 2. Retention chips 28 may be secured to portion 51 so as to be moved away from insert 22 upon separation of portion 51, and line 53 may be continuously curved, partly curved as shown with straight lines or may be all straight lines defined by a combination of perforations or cuts so long as cuts such as 53' are defined as access openings.

Envelope assembly 10*e* shown in FIG. 9 has a plurality of spaced short diagonal cuts or perforations 57 lying in one direction along marginal edge 31, and a plurality of shorter diagonal cuts 58 lying in an opposite direction in portions 59 lying between adjacent cuts 57. An opener such as the addressee's thumb or forefinger, or a letter opener, may be inserted through one of the cuts 57 defining access openings for tearing portions 59 of this outer envelope ply along cuts 57 and 58. The insert is therefore exposed for extraction upon such tearing. Lines 48, 49 and 35 may be applied as in any normal manner to the same outer surface of the envelope so as to together simulate a folded-flap envelope construction.

Stuffed, sealed envelope assembly 10*f* of FIG. 10 is quite similar to envelope 10*b* of FIG. 6. A tear strip 61 is provided in an exterior ply of the envelope assembly, such tear strip lying along marginal edge 31 and overlying edge 36 of the insert. The tear strip is delimited by a pair of spaced parallel lines 61 of perforations having substantially V-shaped lines 62 of perforations at opposite ends thereof. Lines 61 and 62 of perforations define cuts with intervening connecting ties, and such cuts defining access openings through which the operator's thumb or forefinger or a letter opener may be inserted for separating the tear strip along lines 61 and 62, or along marginal edge 31 if desired. Short lines 63 extending from marginal edge 31 and merging with parts of lines 62 are applied to the outer surface of envelope ply 18 for the purpose of outlining together with one of lines 61 a simulated envelope flap. Fold lines 35 are likewise applied to the same outer surface of the envelope so as to give the impression of a folded-flap envelope construction as described with reference to the other embodiments.

Envelope assembly **10*g* of FIG. 11 is similar to that of FIG. 10 except for the shape of its tear strip 63. Such a strip is disposed along marginal edge 31 and overlies edge 36 of the insert, and is delimited by a pair of lines 64 of perforations connected at opposite ends by curved lines 65 of perforations. All lines of perforations have cuts with intervening connecting ties, the cuts providing access openings for the insertion of a letter opener or some other object such as the operator's finger for facilitating removal of the tear strip along its lines of perforations, or for otherwise tearing the envelope along marginal edge 31 or elsewhere. The tear strip is contained at least in part within lines 66 and lines 67 applied to the envelope for outlining a simulated flap, and other fold lines 35** are likewise applied to the envelope for the same purpose as intended with respect to the other described embodiments.

Envelope assembly **10*h* of FIG. 12 is provided with a line 68 of perforations lying along marginal edge 31 slightly inwardly of marginal edge 36 of the insert or just outwardly thereof, if desired, and circular openings 69 are provided in this same outer ply of the envelope at opposite ends of line 68. Such openings 69 therefore provide access openings for a letter opener or some other object such as the operator's finger to facilitate opening of the envelope as it is separated along line 68 or along some other portion of the envelope as, for example, at marginal edge 31. Line 68 and openings 69 are contained within line 71 and 72 applied to the outer surface of the envelope for outlining a simulated envelope flap. And, fold lines 35** are again applied to the envelope for the same purpose as before.

Envelope assembly **10*i* of FIG. 13 is similar to envelope 10 of FIG. 2 except that separable portion 73 is larger by comparison and is defined by straight lines 74 and 75 of perforations. The envelope may be otherwise opened for exposing the insert for extraction similarly as described for envelope 10**.

FIG. 14 discloses a stuffed, sealed envelope assembly **10*j* as having cuts 76 extending inwardly from marginal edge 31 and, together with a line 77 applied to the surface of this ply, outline a simulated envelope flap. Cuts 76 define access openings for the insertion of the operator's finger, a letter opener or some other opening object so that portion 78 of this envelope may be separated by tearing between cuts 76 and perhaps along edge 31. Various combinations of straight and/or curved lines of perforations outlining portion 78** may be used in this embodiment, and in any of the other aforedescribed embodiments wherein such lines outline a simulated envelope flap.

Figure 15:
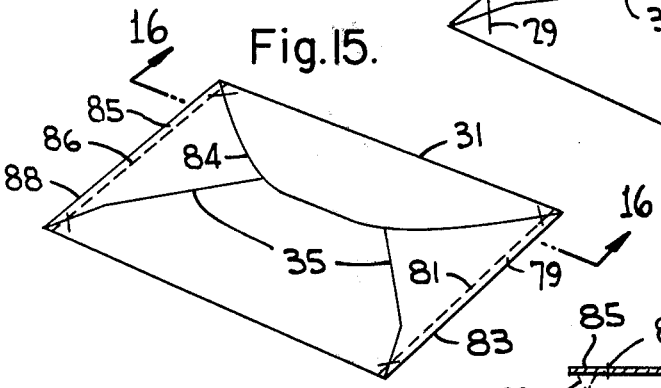
FIG. 15 is a perspective view of yet another embodiment according to the invention.
Figure 16:
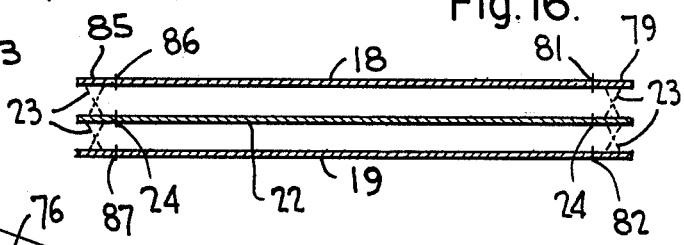
FIG. 16 is a sectional view taken substantially along line 16—16 of FIG. 15.
Figure 17:
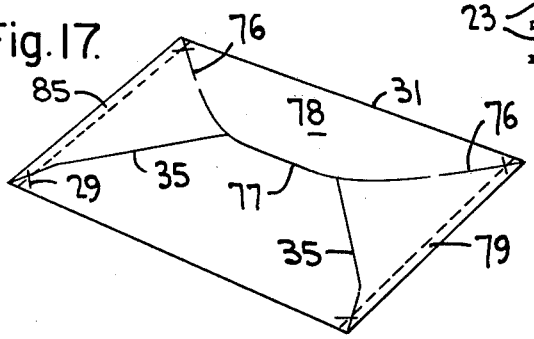
FIG. 17 is a perspective view of still another embodiment according to the invention.

FIGS. 15 and 16 illustrate another means for opening the envelope and exposing the insert material for extraction therefrom. The envelope assembly is constructed with a free insert as described hereinabove, except that such means comprises a removable tear strip 79 defined by superimposed lines 81 and 82 of perforations provided in outer plies 18 and 19 between marginal edge 83 and edge 24 of the insert lying adjacent thereto. As can be seen in FIG. 16, lines 81 and 82 actually lie inwardly of glue lines 23 at marginal edge 31 and slightly outwardly of the adjacent insert edge 24. The outer surface of ply 18 is provided with an outline 84 of a simulated folded flap and with lines 35 simulating other flap folds so that together the envelope assimilates a folded-flap envelope construction. The envelope can be opened for exposing the insert for extraction by simply removing the tear strip. The addressee may then separate the plies, reach in and extract the freely held insert.

An additional removable tear strip 85, defined by superimposed lines 86 and 87 of perforations, may likewise be provided if desired for opening the envelope and exposing the insert for extraction along a different edge of the envelope. Lines 86 and 87 lie between marginal edge 88 and the adjacent insert edge 24, preferably inwardly of glue lines 23 at edge 88 and slightly outwardly of adjacent edge 24.

FIG. 18 shows another embodiment of the invention which is a combination of the envelope constructions of FIGS. 14 and 15. Hence, cut lines 76 of FIG. 14 as well as tear strips 79 and 85 of FIG. 16 are provided in this construction for providing optional means for opening the envelope and exposing the insert for extraction. Also, it should be pointed out that such an optional opening and exposing feature of FIG. 16 (having one or two tear strips) may be provided for any of the aforedescribed embodiments so that any one of the envelope constructions may be opened for exposing the insert for extraction in the same manner as a standard folded-flap envelope construction wherein one side of the envelope is torn off, or the finger or a letter opener is inserted in an unglued opening at the folded flap.

From the foregoing it can be seen that a stuffed, sealed envelope assembly is constructed in such a manner as to give the appearance of a folded-flap envelope construction. However, at the same time, the present envelope assembly is of the stuffed, sealed variety having a "free" insert therein which facilitates easy and unobstructed extraction of the insert because it is unattached within the envelope and no resistance to easy extraction is therefore offered as by connecting ties in those assemblies wherein the inserts are secured in place in some manner. A simulated flap of the present consturction is separated along its line of weakening to thereby open the envelope and expose the insert for extraction. This simulated flap may be partially or totally separated from the envelope or it may be torn along a marginal edge of the envelope with a letter opener or the like. And, alternative constructions likewise permit easy access to the insert as the envelope is opened upon separation along a line of perforations or other weakened line or upon removal of a tear strip delimited by a pair of spaced lines of weakening.

And, since the present envelope assembly is not opened by a "grasp and snap" action or by otherwise removing a tear strip including a portion of both plies and overlying an end of the insert, as by holding the envelope outwardly of a side of the insert and over an opposite side thereof, those insert retention elements lying between lines 14 and 24 may be made more narrow as compared to that shown in other stuffed, sealed envelope assemblies. The insert may therefore be made wider or the envelope more narrow for the same sized insert as before, with a consequent savings in the cost of materials.

Obviously, many modifications and variations of the invention are made possible in the light of the above teachings. It is therefore to be understood that within the scope of the appended claims the invention may be practiced otherwise than as specifically described.

What is claimed is:

1. A stuffed, sealed envelope assembly, comprising, superimposed front and back plies, adhesive means securing said plies together along marginal edges thereof to form an envelope pocket within the assembly, insert material located within said pocket and being unattached to said plies so as to be freely disposed within said pocket, means lying adjacent one of said marginal edges for opening said pocket and exposing said insert material for extraction therefrom, said means comprising at least one cut line extending through only one of said plies and defining a pocket access opening, said cut line lying near one end of an edge of said insert material, said adhesive means securing said plies together along said one marginal edge comprising a stream of releasable glue to thereby further comprise said means for opening and exposing, and said cut line partially delimiting a portion of said one ply which may be separated along said insert material edge from the remainder of said one ply upon insertion of an opener through said access opening, the other of said plies being completely devoid of any means facilitating opening of said pocket, whereby said pocket may be opened and said insert material exposed for extraction therefrom as said portion is separated along said insert material edge from said remainder of said one ply upon exertion by the opener of a force causing the separation after the opener is inserted through said access opening.

2. The envelope assembly according to claim 1, wherein said means for opening and exposing comprise a plurality of perforations including said cut line, at least said perforations extending along said one marginal edge, said perforations extending through said one ply and defining pocket access openings, said perforations lying along said insert material edge between opposite ends thereof, and said perforations permitting said portion to be separated from said remainder of said one ply upon insertion of the opener through one of said access openings, whereby said pocket may be opened and said insert material exposed for extraction therefrom as said portion is separated between said perforations from said remainder of said one ply upon exertion by the opener of a force causing the separation after the opener is inserted through said one access opening.

3. A stuffed, sealed envelope assembly, comprising, superimposed front and back plies, adhesive means securing said plies together along marginal edges thereof to form an envelope pocket within the assembly, insert material located within said pocket and being unattached to said plies so as to be freely disposed within said pocket, means for immobilizing said insert material and for maintaining said insert material in a desired registration position within said pocket, means lying adjacent one of said marginal edges for opening said pocket and exposing said insert material for extraction therefrom, said opening and exposing means being the sole means for opening said pocket and exposing said insert material for extraction therefrom, said opening and exposing means comprising at least one cut line extending through only one of said plies and defining a pocket access opening, said cut line lying near one end of an edge of said insert material and partially delimiting a portion of said one ply which may be separated along said insert edge from the remainder of said one ply upon insertion of an opener through said access opening, said cut line being oriented to outline part of a simulated fold flap, and flap lines applied to an outer surface of said one ply for simulating a folded-flap envelope construction, whereby the assembly is devoid of any sealed flaps enclosing said insert material, and whereby said pocket may be opened for exposing said insert material for extraction therefrom only as said portion is separated along said insert edge from said remainder of said one ply upon exertion by the opener of a force causing the separation after the opener is inserted through said access opening.

4. The envelope assembly according to claim 3, wherein a fold flap line is applied to said outer surface of said one ply and defines another portion of said simulated fold flap outline.

5. The envelope assembly according to claim 3, wherein said means for opening and exposing comprises a first line of perforations including said cut line and lying along said one marginal edge between opposite ends of said insert edge, said first line of perforations being oriented to outline the simulated fold flap, and said flap lines extending away from said simulated flap outline.

6. The envelope assembly according to claim 5, wherein a second line of perforations extends through only said one ply and lies along said one marginal edge, said first and second lines of perforations together defining a tear strip which, when removed, exposes said insert edge for extraction.

7. The envelope assembly according to claim 3, wherein said means for opening and exposing comprises a pair of spaced cut lines extending through only said one ply and lying along said one marginal edge at opposite ends of said insert edge, said cut lines being oriented to outline part of the simulated fold flap, a fold flap line applied to said outer surface of said one ply defining the remainder of said simulated fold flap outline, and said flap lines extending away from said simulated flap outline.

8. An assembly formed of superimposed, continuous sheets having spaced transverse lines of weakening defining a succession of interconnected sealed envelopes, comprising: front and back panels; adhesive means securing said panels together along marginal edges thereof to form an envelope pocket, insert material located within said pocket and being unattached to said panels so as to be freely disposed within said pocket; means for immobilizing said insert material and for maintaining said insert material in a desired registration position within said pocket; means lying adjacent one of said marginal edges for opening said pocket and exposing said insert material for extraction therefrom, said opening and exposing means being the sole means for opening said pocket and exposing said insert material for extraction therefrom; said opening and exposing means comprising at least one cut line extending through only one of said panels and defining a pocket access opening; said cut line lying near one end of an edge of said insert material and partially delimiting a portion of said one panel which may be separated along said insert edge from the remainder of said one panel upon insertion of an opener through said access opening; said cut line being oriented to outline part of a simulated fold flap; and flap lines applied to an outer surface of said one panel for simulating a folded-flap envelope construction; whereby each sealed envelope is devoid of any sealed flaps enclosing said insert material, and whereby said pocket may be opened for exposing said insert material for extraction therefrom only as said portion is separated along said insert edge from said remainder of said one panel upon exertion by the opener of a force causing the separation after the opener is inserted through said access opening.

* * * * *

UNITED STATES PATENT OFFICE

CERTIFICATE OF CORRECTION

PATENT NO. : 4,166,539

DATED : September 4, 1979

INVENTOR(S) : Robert H. Allen et al

It is certified that error appears in the above-identified patent and that said Letters Patent are hereby corrected as shown below:

On the title page, after "Inventors:", delete "Robert H. Allen, North Tonawanda; Victor J. Robertson, Niagara Falls, both of N.Y." and substitute --Robert H. Allen, North Tonawanda, N.Y.--.

Signed and Sealed this

*Twelfth* Day of *February 1980*

[SEAL]

*Attest:*

SIDNEY A. DIAMOND

*Attesting Officer*

*Commissioner of Patents and Trademarks*